US007348114B2

(12) United States Patent
Wu et al.

(10) Patent No.: US 7,348,114 B2
(45) **Date of Patent: *Mar. 25, 2008**

(54) PHOTOCONDUCTIVE MEMBERS

(75) Inventors: Jin Wu, Webster, NY (US); Cindy C. Chen, Rochester, NY (US); Robert P. Altavela, Farmington, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 402 days.

This patent is subject to a terminal disclaimer.

(21) Appl. No.: 11/126,664

(22) Filed: May 11, 2005

(65) Prior Publication Data

US 2006/0257766 A1 Nov. 16, 2006

(51) Int. Cl.
*G03G 5/047* (2006.01)

(52) U.S. Cl. ..... 430/58.8; 430/58.05; 430/59.4

(58) Field of Classification Search ..... 430/58.8, 430/58.05, 59.4
See application file for complete search history.

(56) References Cited

U.S. PATENT DOCUMENTS 3,121,006 A 2/1964 Middleton et al.
4,265,990 A 5/1981 Stolka et al.
4,555,463 A 11/1985 Hor et al.
4,587,189 A 5/1986 Hor et al.
4,921,769 A 5/1990 Yuh et al.
5,473,064 A 12/1995 Mayo et al.
5,482,811 A 1/1996 Keoshkerian et al.
6,015,645 A 1/2000 Murti et al.
6,156,468 A 12/2000 Wehelie et al.
6,177,219 B1 1/2001 Yuh et al.
6,255,027 B1 7/2001 Wehelie et al.
6,287,737 B1 9/2001 Ong et al.
6,780,554 B2 * 8/2004 Tong et al. ..... 430/58.8
6,800,411 B2 10/2004 Tong et al.
7,001,700 B2 * 2/2006 Wu et al. ..... 430/65
2004/0161683 A1 8/2004 Wu et al.
2004/0161684 A1 8/2004 Wu et al.
2005/0014080 A1 1/2005 Tong et al.
2005/0164104 A1 * 7/2005 Tong et al. ..... 430/58.05

* cited by examiner

*Primary Examiner*—John I Goodrow
(74) *Attorney, Agent, or Firm*—E. O. Palazzo

(57) ABSTRACT

A photoconductive imaging member containing a photogenerating layer, and a charge transport layer containing a binder and a polyol ester.

31 Claims, No Drawings

PHOTOCONDUCTIVE MEMBERS

CROSS REFERENCES

Illustrated in copending application U.S. Ser. No. 11/126,463, filed May 11, 2005, U.S. Publication No. 2006/0257769, the disclosure of which is totally incorporated herein by reference, is, for example, a photoconductive imaging member comprised of a photogenerating layer, and a charge transport layer containing a binder and an amorphous polyimide.

Illustrated in U.S. Pat. No. 7,094,509, filed Jul. 18, 2003 and entitled Photoconductive Members, the disclosure of which is totally incorporated herein by reference, is, for example, a photoconductive imaging member comprised of a photogenerating layer, and a charge transport layer containing a binder and a fluoropolymer generated by the free radical polymerization of a fluoroalkyl(methyl)acrylate and an alkyl(methyl)acrylate.

Illustrated in U.S. Pat. No. 6,800,411, the disclosure of which is totally incorporated herein by reference, is, for example, a photoconductive imaging member comprised of a substrate, a photogenerating layer, and a charge transport layer containing a binder and a multi(methyl)acrylate.

There is illustrated in U.S. Pat. No. 7,094,509, filed Feb. 19, 2003 on Photoconductive Imaging Members, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether and hydroxy group containing polymer.

There is illustrated in U.S. Pat. No. 6,913,863, filed Feb. 19, 2003 on Photoconductive Imaging Members, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of phenolic compounds and a phenolic resin wherein the phenolic compound contains at least two phenol groups.

There is illustrated in U.S. Pat. No. 6,824,940, the disclosure of which is totally incorporated herein by reference, is a photoconductive imaging member comprised of a hole blocking layer, a photogenerating layer, a charge transport layer, and thereover an overcoat layer comprised of a polymer with a low dielectric constant and charge transport molecules.

The components, such as photogenerating pigments, charge transport compounds, supporting substrates, hole blocking layers and binder polymers, and processes of the copending applications may be selected for the present disclosure in embodiments thereof.

RELATED PATENTS

Illustrated in U.S. Pat. No. 6,015,645, the disclosure of which is totally incorporated herein by reference, is a photoconductive imaging member comprised of a supporting substrate, a hole blocking layer, an optional adhesive layer, a photogenerator layer, and a charge transport layer, and wherein the blocking layer is comprised, for example, of a polyhaloalkylstyrene.

Illustrated in U.S. Pat. No. 6,287,737, the disclosure of which is totally incorporated herein by reference, is a photoconductive imaging member comprised of a supporting substrate, a hole blocking layer thereover, a photogenerating layer and a charge transport layer, and wherein the hole blocking layer is comprised of a crosslinked polymer derived from the reaction of a silyl-functionalized hydroxyalkyl polymer of Formula (I) with an organosilane of Formula (II) and water

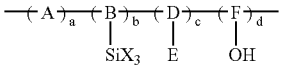

(I)

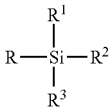

(II)

wherein A, B, D, and F represent the segments of the polymer backbone; E is an electron transporting moiety; X is selected from the group consisting of halide, cyano, alkoxy, acyloxy, and aryloxy; a, b, c, and d are mole fractions of the repeating monomer units such that the sum of a+b+c+d is equal to 1; R is alkyl, substituted alkyl, aryl, or substituted aryl; and $R^1$, $R^2$, and $R^3$ are independently selected from the group consisting of alkyl, aryl, alkoxy, aryloxy, acyloxy, halogen, cyano, and amino, subject to the provision that two of $R^1$, $R^2$, and $R^3$ are independently selected from the group consisting of alkoxy, aryloxy, acyloxy, and halide.

Illustrated in U.S. Pat. No. 5,473,064, the disclosure of which is totally incorporated herein by reference, is a process for the preparation of hydroxygallium phthalocyanine Type V, essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts $DI^3$, for each part of gallium chloride that is reacted; hydrolyzing the pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ballmilling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components and processes of the above patents may be selected for the present disclosure in embodiments thereof.

BACKGROUND

This disclosure is generally directed to imaging members, and more specifically, the present disclosure is directed to multi-layered photoconductive imaging members with a photogenerating layer, a charge transport layer, an optional hole blocking, or undercoat layer (UCL), and wherein the charge transport layer can be comprised of charge, especially hole transport components, and at least one polyol ester, which ester can function, for example, as a lubricant. A number of advantages are associated with the members illustrated herein, such as enabling extended life times and excellent wear resistant characteristics; very acceptable compatibility properties with toners generated by emulsion aggregation processes as illustrated in a number of Xerox patents; excellent PIDC cyclic stability at a number of different humidities, for example from about 25 to about 90 percent relative humidity; and improved toner cleanability.

In embodiments, the imaging members of the present disclosure possess a charge transport or top layer with excellent resistance to cracking against exposure to chemical vapors emitted from solvents. The charge transport layer's solvent vapor resistance and/or its anti-organic solvent characteristics can be determined by the known solvent vapor induced crystallization test, wherein the imaging member is subjected to exposure by the vapor of common organic solvents, such as for example, methylene chloride, isopropyl alcohol, propylene glycol, a cyclic siloxane of an eight member ring polydimethylsiloxane, tetrahydrofuran, toluene, and the like. As illustrated herein, in embodiments the imaging members of the present disclosure exhibit excellent cyclic/environmental stability; excellent wearability characteristics; enhanced toner image transfer efficiency to the image receiving member; extended lifetimes of, for example, up to 3,500,000 imaging cycles; acceptable and in some instances improved electrical characteristics; members which can be economically prepared with tunable or preselected properties depending, for example, on the amount of polyol ester lubricant contained in the charge transport layer; and improved compatibility with a number of toner compositions.

In embodiments, the photogenerating layer can be situated between the charge transport layer and the supporting substrate, and the hole blocking layer in contact with the supporting substrate can be situated between the supporting substrate and the photogenerating layer, which is comprised, for example, of the photogenerating pigments of U.S. Pat. No. 5,482,811, the disclosure of which is totally incorporated herein by reference, especially Type V hydroxygallium phthalocyanine, and generally metal free phthalocyanines, metal phthalocyanines, hydroxy gallium phthalocyanines, perylenes, titanyl phthalocyanines, vanadyl phthalocyanines, selenium, selenium alloys, azo pigments, and the like.

Processes of imaging, especially xerographic imaging and printing including digital, are also encompassed by the present disclosure. More specifically, the photoconductive imaging members of the present disclosure can be selected for a number of different known imaging and printing processes including, for example, electrophotographic imaging processes, especially xerographic imaging and printing processes wherein charged latent images are rendered visible with toner compositions of an appropriate charge polarity. The imaging members are in embodiments sensitive in the wavelength region of, for example, from about 475 to about 950 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

Layered photoresponsive imaging members have been illustrated in numerous U.S. patents, such as U.S. Pat. No. 4,265,990, the disclosure of which is totally incorporated herein by reference, wherein there is illustrated an imaging member comprised of a photogenerating layer, and an arylamine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

Further, in U.S. Pat. No. 4,555,463, the disclosure of which is totally incorporated herein by reference, there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene, pigment photogenerating component. Also known are charge transport aryl amine components, such as N,N'-diphenyl-N,N'-bis(3-methylhenyl)-1,1'-biphenyl-4,4'-diamine dispersed in a polycarbonate binder as a hole transport layer. The above components, such as the photogenerating compounds and the aryl amine charge transport molecules, can be selected for the imaging members of the present disclosure in embodiments thereof.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors, and specifically, for example, imaging members containing a hole blocking layer of a plurality of light scattering particles dispersed in a binder, reference for Example I of U.S. Pat. No. 6,156,468, the disclosure of which is totally incorporated herein by reference, wherein there is illustrated a hole blocking layer of titanium dioxide dispersed in a specific linear phenolic binder of VARCUM, available from OxyChem Company.

SUMMARY

It is a feature of the present disclosure to provide imaging members with many of the advantages illustrated herein, such as extended lifetimes of service of, for example, in excess of about 3,500,000 imaging cycles; excellent electronic characteristics; stable electrical properties; resistance to charge transport layer cracking upon exposure to the vapor of certain solvents; superior surface characteristics; improved wear resistance; compatibility with a number of toner compositions, and the like.

Another feature of the present disclosure relates to the provision of layered photoresponsive imaging members, which are responsive to near infrared radiation of from about 700 to about 900 nanometers.

It is yet another feature of the present disclosure to provide layered photoresponsive imaging members with sensitivity to visible light.

Moreover, another feature of the present disclosure relates to the provision of layered photoresponsive imaging members with mechanically robust and solvent resistant charge transport layers.

In a further feature of the present disclosure there are provided imaging members containing polyol esters in the top layer of the member, which layer can be for example, a charge transport layer, a protective overcoating layer, and the like.

Moreover, in yet another feature of the present disclosure there are provided imaging members with optional hole blocking layers comprised of metal oxides, phenolic resins, and optional phenolic compounds, and which phenolic compounds containing at least two, and more specifically, two to ten phenol groups or phenolic resins with a weight average molecular weight ranging from about 500 to about 2,000, can interact with and consume aldehyde compounds, such as formaldehyde and other phenolic precursors, thereby chemically modifying the properties for such resins and permitting, for example, a hole blocking layer with excellent efficient electron transport, and which usually results in a desirable lower residual potential $V_{low}$.

Aspects of the present disclosure relate to a member comprised of a photogenerating layer, and a charge transport layer containing at least one charge transport component, binder and a polyol ester; a photoconductive imaging member comprised in sequence of a substrate, a photogenerating layer, and a charge transport layer comprised of charge transport molecules, a polymer and a polyol ester; a photoconductive imaging member comprised of a supporting substrate, a hole blocking layer thereover, a photogenerating layer and a charge transport layer comprised of hole transport molecules, binder, and polyol ester; and optionally a top layer comprised, for example, of known low dielectric components; a photoconductive imaging member wherein the supporting substrate is comprised of a known component, such as a conductive metal substrate; a photoconductive imaging member wherein the conductive substrate is aluminum, aluminized polyethylene terephthalate or a titanized polyethylene naphthalate; a photoconductive imaging member wherein the photogenerating layer is of a thickness of from about 0.05 to about 12 microns; a photoconductive imaging member wherein the charge, such as hole transport layer, is of a thickness of from about 10 to about 75 microns; a photoconductive imaging member wherein the photogenerating layer is comprised of photogenerating pigments dispersed in an optional resinous binder in an amount of from about 5 percent by weight to about 95 percent by weight; a photoconductive imaging member wherein the photogenerating resinous binder is selected from the group consisting of copolymers of vinyl chloride, vinyl acetate and hydroxy and/or acid containing monomers, polyesters, polyvinyl butyrals, polycarbonates, polystyrene-b-polyvinyl pyridine, and polyvinyl formals; a photoconductive imaging member wherein the charge transport layer comprises a thermoplastic polymer binder and aryl amine molecules; a photoconductive imaging wherein the charge transport contains

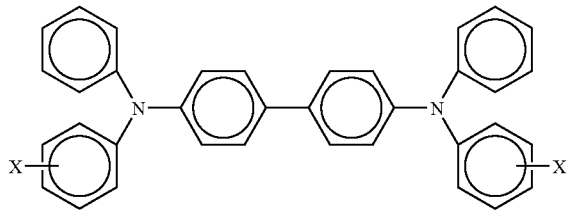

wherein X is selected from the group consisting of alkyl, alkoxy and halogen, and wherein the aryl amine is dispersed in a resinous binder; a photoconductive imaging member wherein the aryl amine alkyl is methyl, wherein halogen is chloride, and wherein the resinous binder is selected from the group consisting of polycarbonates and polystyrene; a photoconductive imaging member wherein the aryl amine is N,N'-diphenyl-N,N-bis(3-methyl phenyl)-1,1'-biphenyl-4,4'-diamine; a photoconductive imaging member wherein the photogenerating layer is comprised of metal phthalocyanines, or metal free phthalocyanines; a photoconductive imaging member wherein the photogenerating layer is comprised of titanyl phthalocyanines, perylenes, alkylhydroxygallium phthalocyanines, hydroxygallium phthalocyanines, or mixtures thereof; a photoconductive imaging member wherein the photogenerating layer is comprised of Type V hydroxygallium phthalocyanine; a method of imaging which comprises generating an electrostatic latent image on the imaging member illustrated herein, developing the latent image, especially wherein developing is accomplished with a toner generated by emulsion/aggregation/coalescence processes; and transferring the developed electrostatic image to a suitable substrate; an imaging member wherein the hole blocking layer phenolic compound is bisphenol S, 4,4'-sulfonyldiphenol; an imaging member wherein the phenolic compound is bisphenol A, 4,4'-isopropylidenediphenol; an imaging member wherein the phenolic compound is bisphenol E, 4,4'-ethylidenebisphenol; an imaging member wherein the phenolic compound is bisphenol F, bis(4-hydroxyphenyl)methane; an imaging member wherein the phenolic compound is bisphenol M, 4,4'-(1,3-phenylenediisopropylidene) bisphenol; an imaging member wherein the phenolic compound is bisphenol P, 4,4'-(1,4-phenylenediisopropylidene) bisphenol; an imaging member wherein the phenolic compound is bisphenol Z, 4,4'-cyclohexylidenebisphenol; an imaging member wherein the phenolic compound is hexafluorobisphenol A, 4,4'-(hexafluoroisopropylidene) diphenol; an imaging member wherein the phenolic compound is resorcinol, 1,3-benzenediol; an imaging member wherein the phenolic compound is hydroxyquinone, 1,4-benzenediol and catechin; an imaging member wherein the phenolic resin is selected from the group consisting of a formaldehyde polymer generated with phenol, p-tert-butylphenol and cresol; a formaldehyde polymer generated with ammonia, cresol and phenol; a formaldehyde polymer generated with 4,4'-(1-methylethylidene) bisphenol; a formaldehyde polymer generated with cresol and phenol; and a formaldehyde polymer generated with phenol and p-tert-butylphenol; an imaging member comprised in the sequence of a supporting substrate, a hole blocking layer, an optional adhesive layer, a photogenerating layer, and a charge transport layer as illustrated herein; an imaging member wherein the adhesive layer is comprised of a polyester with an $M_w$ of about 45,000 to about 75,000, and an Mn of from about 30,000 to about 40,000; an imaging member wherein the photogenerator layer is of a thickness of from about 1 to about 5 microns, and wherein the transport layer is of a thickness of from about 20 to about 75 microns; an imaging member wherein the photogenerating layer is comprised of photogenerating pigments dispersed in a resinous binder in an amount of from about 15 percent by weight to about 90 percent by weight, and optionally wherein the resinous binder is selected from the group comprised of vinyl chloride/vinyl acetate copolymers, polyesters, polyvinyl butyrals, polycarbonates, polystyrene-b-polyvinyl pyridine, and polyvinyl formals; and an imaging member wherein the charge transport layer comprises suitable known or future developed components, and more specifically, aryl amines, and which aryl amines are molecules of the formula

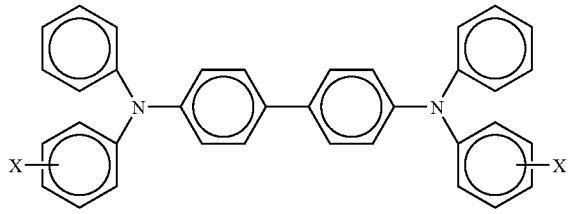

wherein X is alkyl and the like; and which amines are dispersed in a binder polymer and the polyol ester illustrated herein.

The concentration of the polyol ester in the photoconductor surface layer, or top layer, such as the charge transport layer is, for example, from about 0.1 weight percent to 30 weight percent by the weight of the total solid contents, and more specifically, from about 3 weight percent to about 20, and yet more specifically, from 4 to about 10 weight percent based on the weight of the total solid contents of the charge transport layer. In embodiments, the ratio in weight percentage of the binder, the charge transport component and the polyol ester of the charge transport layer is from about 70/30/20 to about 50/50/1, and yet more specifically, from about 60/40/10 to about 55/45/5.

A number of polyol esters can be selected for the charge transport layer. In embodiments, polyol esters can, for example, be referred to as an ester generated from the reaction of a polyol containing one or more hydroxyl groups in one molecule with one or plural monobasic acids or acid halides. Suitable polyol examples may be selected from saturated and unsaturated straight and branched chain linear aliphatic; saturated and unsaturated cyclic aliphatics, including heterocyclic aliphatic; or mononuclear or polynuclear aromatics, including heterocyclic aromatics alcohols. Polyols with one hydroxyl group include methanol, ethanol, 1-propanol, 2-propanol, 1-butanol, 2-butanol, ethoxy ethanol, propoxy ethanol, butoxy ethanol, ethoxy propanol, propoxy propanol, butoxy propanol, ethoxy butanol, propoxy butanol, and butoxy butanol. Polyols with two or more hydroxyl groups include hindered alcohols with for example, from about 5 to about 30 carbon atoms, for example, neopentyl glycol, 2,2-diethyl propane-1,3-diol, 2,2-dibutyl propane-1,3-diol, 2-methyl-2-propyl propane-1,3-diol, 2-ethyl-2-butyl propane-1,3-diol, trimethylol ethane, trimethylol propane, ditrimethylol propane, tritrimethylol propane, tetratrimethylol propane, pentaerythritol, dipentaerythritol, tripentaerythritol, tetrapentaerythritol, and pentapentaerythritol, or mixtures thereof. Specific hindered alcohols are those with from about 5 to about 10 carbon atoms such as trimethylol propane, ditrimethylol propane, pentaerythritol, dipentaerythritol, and tripentaerythritol. Polyols also include carbohydrate molecules, such as monosaccharides including, for example, mannose, galactose, arabinose, xylose, ribose, apiose, rhamnose, psicose, fructose, sorbose, tagitose, ribulose, xylulose, and erythrulose. Oligosaccharides include, for example, maltose, kojibiose, nigerose, cellobiose, lactose, melibiose, gentiobiose, turanose, rutinose, trehalose, sucrose and raffinose. Polysaccharides include, for example, amylose, glycogen, cellulose, chitin, inulin, agarose, zylans, mannan and galactans. Although perhaps sugar alcohols may not be considered carbohydrates, the naturally occurring sugar alcohols are very closely related to carbohydrates. Examples of sugar alcohols are sorbitol, mannitol and galactitol.

Examples of the monobasic acids include saturated aliphatic carboxylic acids, such as acetic acid, propionic acid, butyric acid, isobutyric acid, valeric acid, pivalic acid, heptanoic acid, octanoic acid, nonanoic acid, decanoic acid, lauric acid, myristic acid and palmitic acid; unsaturated aliphatic carboxylic acids, such as stearic acid, acrylic acid, propionic acid, crotonic acid and oleic acid; and cyclic carboxylic acids, such as benzoic acid, toluic acid, napthoic acid, cinnamic acid, cyclohexanecarboxylic acid, nicotinic acid, isonicotinic acid, 2-furoic acid, 1-pyrrolecarboxylic acid, monoethyl malonate and ethyl hydorgenphthalate. Suitable saturated fatty acids include, for example, capric, lauric, palmitic, stearic, behenic, isomyristic, isomargaric, myristic, caprylic, and anteisoarachadic. Suitable preferred unsaturated fatty acids include, for example, maleic, linoleic, licanic, oleic, linolenic, and erydiogenic acids. Mixtures of fatty acids derived from soybean oil, palm oil, coconut oil, cottonseed and fatty hydrogenated rapeseed oil can also be selected. Examples of acid halides, such as acid chlorides, include the chlorides of the monobasic acids.

Specific examples of polyol esters are neopentyl glycol as NPG, trimethylol propane as TMP, ditrimethylol propane as DTMP, pentaerythritol as PE, dipentaerythritol as DPE, and tripentaerythritol as TPE). In embodiments there can be selected NPG-di(n-butanoate), NPG-di(2-methylpropanoate), NPG-di(n-pentanoate), NPG-di(2-methylbutanoate), NPG-di(n-hexanoate), NPG-di(2-ethylbutanoate), NPG-di(3-ethylbutanoate), NPG-di(n-heptanoate), NPG-di (2-ethylpentanoate), NPG-di(n-octanoate), NPG-di(2-ethylhexanoate), NPG-di(n-nonanate), NPG-di(isononanate), NPG-di(n-decanoate), NPG-di(mixed(n-hexanoate, n-butanoate)), NPG-di(mixed(n-hexanoate, n-pentanoate)), NP di(mixed(n-butanoate, n-heptanoate)), TMP-tri(n-butanoate), TMP-tri(2-methylpropanoate), TMP-tri(n-pentanoate), TMP-tri(2-methylbutanoate), TMP-tri(n-hexanoate), TMP-tri(3-ethylbutanoate), TMP-tri(n-heptanoate), TMP-tri(2-ethylpentanoate), TMP-tri(n-octanoate), TMP-tri (2-ethylhexanoate), TMP-tri(n-nonanate), TMP-tri (isononanate), TMP-tri(n-decanoate), TMP-tri(isodecanoate), TMP-tri(mixed(n-butanoate, n-hexanoate)), DTMP-tetra(n-butanoate), DTMP-tetra(2-methylpropanoate), DTMP-tetra(n-pentanoate), DTMP-tetra(2-methylbutanoate), DTMP-tetra(n-hexanoate), DTMP-tetra(3-ethylbutanoate), DTMP-tetra(n-heptanoate), DTMP-tetra(2-ethylhexanoate), DTMP-tetra(n-octanoate), DTMP-tetra(2-ethylhexanoate), DTMP-tetra(n-nonanate), DTMP-tetra (isononanate), DTMP-tetra(n-decanoate), DTMP-tetra (isodecanoate), DTMP-tetra[mixed(n-butanoate, n-hexanoate)], DTMP-tetra[mixed(n-pentanoate, isohexanoate)], PE-tetra(n-butanoate), PE-tetra(2-methylpropanoate), PE-tetra(n-pentanoate), PE-tetra(2-methylbutanoate), PE-tetra(2,2-dimethylpropanoate), PE-tetra(n-hexanoate), PE-tetra(2-ethylbutanoate), PE-tetra(2,2-dimethylbutanoate), PE-tetra(n-heptanoate), PE-tetra(2-ethylpentanoate), PE-tetra(n-octanoate), PE-tetra(2-ethylhexanoate), PE-tetra(n-nonanate), PE-tetra (isononanate), PE-tetra(n-decanoate), PE-tetra (isodecanoate), PE-tetra(n-decanoate), PE-tetra (isodecanoate), PE-tetra[mixed(n-pentanoate, isopentanoate, n-hexanoate, n-butanoate)], PE-tetra[mixed (n-pentanoate, isopentanoate, n-heptanoate, n-nonanate)], DPE-hexa(n-butanoate), DPE-hexa(2-methylpropanoate), DPE-hexa(n-pentanoate), DPE-hexa(2-methylbutanoate), DPE-hexa(3-methylbutanoate), DPE-hexa(2,2-dimethylpropanoate), DPE-hexa(n-hexanoate), DPE-hexa(2-ethylbutanoate), DPE-hexa(2,2-dimethylbutanoate), DPE-hexa(n-heptanoate), DPE-hexa(2-ethylpentanoate), DPE-hexa(n-octanoate), DPE-hexa(2-ethylhexanoate), DPE-hexa(n-nonanate), DPE-hexa(isononanate), DPE-hexa(n-decanoate), DPE-hexa[mixed(n-pentanoate, isopentanoate, n-heptanoate, n-nonanate)], TPE-octa(n-butanoate), TPE-octa(2-methylpropanoate), TPE-octa(n-pentanoate), TPE-octa(2-methylbutanoate), TPE-octa(2,2-dimethylpropanoate), TPE-octa(n-hexanoate), TPE-octa(2-ethylbutanoate), TPE-octa(n-octanoate), TPE-tetra(2-ethylhexanoate), TPE-octa(n-nonanate), TPE-octa (isononanate), TPE-octa(n-decanoate), TPE-octa[mixed(n-pentanoate, isopentanoate, hexanoate, n-butanoate)], TPE-octa[mixed(isopentanoate, n-hexanoate)], TPE-octa[mixed (n-pentanoate, isopentanoate, n-heptanoate, n-nonanate)] esters of PE, and a mixture containing linear and branched aliphatic acids of, for example, from about 4 to about 10 carbon atoms. Examples of polyol esters also include a neopentyl glycol caprylate caprate mixed ester, a trimethylolpropane valerate heptanoate mixed ester, a trimethylolpropane decanoate octanoate mixed ester, trimethylolpropane nananoate, and a pentaerythritol heptanoate caprate mixed ester. Specifically, in embodiments a polyol ester with about than 4 or less, including no hydroxyl groups can be selected.

Moreover, polyol esters, and/or dibasic acid esters can be incorporated into top layer of the imaging member. Dibasic acid esters include an adipate, azelate, sebacate, 1,9-nonamethylene dicarboxylic acid ester and so on. A complex ester can also be selected. As an alcohol for the dibasic acid ester, a linear or branched, a mono- or polyhydric aliphatic alcohol with, for example, from about 4 to about 20, or from about 8 to about 14 carbon atoms can be utilized. Examples of dibasic acid esters include dioctyl adipate, dioctyl sebacate, diisodecyl adipate, and didecyl adipate. As the organic ester, a polyol ester is selected.

Examples of polyol esters are illustrated with reference to the following wherein R is as indicated herein, and more specifically, wherein R is an alkyl, such as an alkyl containing from about 6 to about 10 carbons

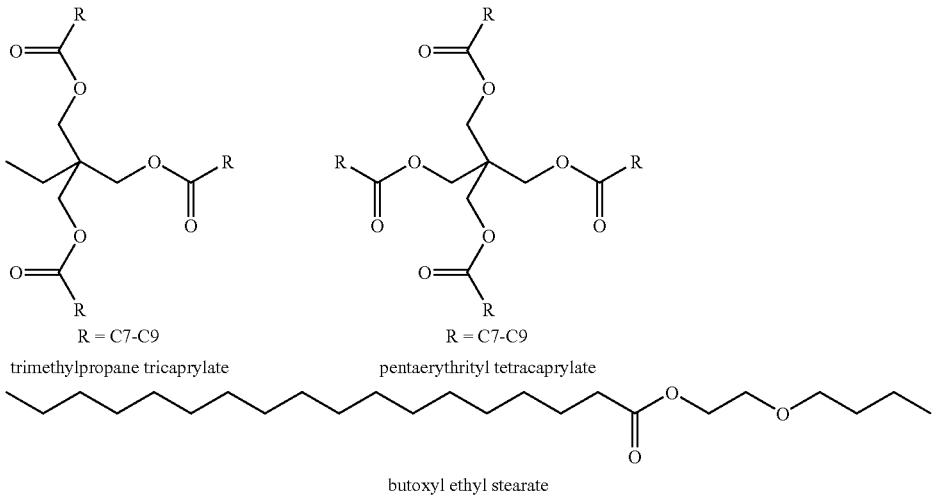

Illustrative examples of substrate layers selected for the imaging members of the present disclosure, and which substrates can be opaque, substantially transparent, and the like comprise a layer of insulating material including inorganic or organic polymeric materials, such as MYLAR® a commercially available polymer of a biaxially oriented polyethylene terephthalate available from E.I. Dupont, and containing a conductive metallized titanium surface, alternatively a layer of an organic or inorganic material with a semiconductive surface layer, such as indium tin oxide, or aluminum arranged thereon, or a conductive material inclusive of aluminum, chromium, nickel, brass or the like. The substrate may be flexible, seamless, or rigid, and may have a number of many different configurations, such as for example, a plate, a rigid cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available from Bayer as MAKROLON® to retain the imaging member in a flat configuration.

The thickness of the substrate layer depends on many factors, including economical considerations, electrical characteristics, and the like, thus this layer may be of substantial thickness, for example over 3,000 microns, such as from about 300 to about 500 microns, or of minimum thickness. In embodiments, the thickness of this layer is from about 75 microns to about 300 microns.

The photogenerating layer, which can, for example, be comprised of hydroxygallium phthalocyanine Type V, is in embodiments comprised of, for example, about 60 weight percent of Type V and about 40 weight percent of a resin binder like polyvinylchloride vinylacetate copolymer such as VMCH (Dow Chemical). The photogenerating layer can contain known photogenerating pigments, such as metal phthalocyanines, metal free phthalocyanines, alkylhydroxyl gallium phthalocyanines, hydroxygallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerator layer depends on a number of factors, including the thicknesses of the other layers and the amount of photogenerator material contained in the photogenerating layers. Accordingly, this layer can be of a thickness of, for example, from about 0.05 micron to about 10 microns, and more specifically, from about 0.25 micron to about 2 microns when, for example, the photogenerator compositions are present in an amount of from about 30 to about 75 percent by volume. The maximum thickness of this layer in embodiments is dependent primarily upon factors, such as photosensitivity, electrical properties and mechanical considerations. The photogenerating layer binder resin present in various suitable amounts, for example from about 1 to about 50, and more specifically, from about 1 to about 10 weight percent, may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. Examples of coating solvents for the photogenerator layers are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The coating of the photogenerator layer in embodiments of the present disclosure can be accomplished with spray, dip or wire-bar methods such that the final dry thickness of the photogenerator layer is as illustrated herein and can be, for example, from about 0.01 to about 30 microns after being dried at, for example, about 40° C. to about 150° C. for about 15 to about 90 minutes.

Illustrative examples of polymeric binder materials that can be selected for the photogenerator layer are as indicated herein, and include those polymers as disclosed in U.S. Pat. No. 3,121,006, the disclosure of which is totally incorporated herein by reference. In general, the amount of polymer binder that is present in the photogenerator layer is from about 0 to about 95 percent by weight, and preferably from about 25 to about 60 percent by weight of the photogenerator layer.

As optional adhesive layers usually in contact with the hole blocking layer and photogenerator layer, there can be selected various known substances inclusive of copolyesters, polyamides, poly(vinyl butyral), poly(vinyl alcohol), polyurethane and polyacrylonitrile. This layer is, for example, of a thickness of from about 0.001 micron to about 1 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Aryl amines selected for the charge, especially hole transporting layers, which generally are of a thickness of from about 5 microns to about 75 microns, and more specifically, of a thickness of from about 10 microns to about 40 microns, include molecules of the following formula

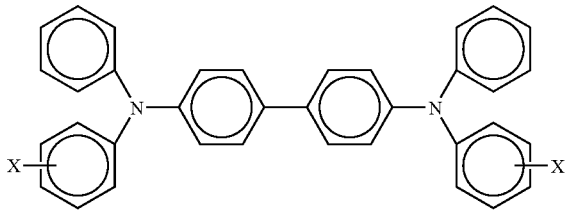

wherein X is alkyl, alkoxy, aryl, a halogen, or mixtures thereof, and especially those substituents selected from the group consisting of Cl and $CH_3$.

Examples of specific aryl amines are N,N'-diphenyl-N,N'-bis(alkylphenyl)-1,1-biphenyl-4,4'-diamine wherein alkyl is selected from the group consisting of methyl, ethyl, propyl, butyl, hexyl, and the like; and N,N'-diphenyl-N,N'-bis(halophenyl)-1,1'-biphenyl-4,4'-diamine wherein the halo substituent is preferably a chloro substituent. Other known charge transport layer molecules can be selected, reference for example, U.S. Pat. Nos. 4,921,773 and 4,464,450, the disclosures of which are totally incorporated herein by reference.

Examples of the binder materials selected for the charge transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies, and random or alternating copolymers thereof. Preferred electrically inactive binders are comprised of polycarbonate resins with a molecular weight of from about 20,000 to about 100,000 with a molecular weight $M_w$ of from about 50,000 to about 100,000 being particularly preferred. Generally, the transport layer contains from about 10 to about 75 percent by weight of the charge transport material, and more specifically, from about 35 percent to about 50 percent of this material.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like, a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene)diphenol), resorcinol; hydroxyquinone, catechin and the like.

The hole blocking layer can be, for example, comprised of from about 20 weight percent to about 80 weight percent, and more specifically, from about 55 weight percent to about 65 weight percent of a metal oxide, such as $TiO_2$, from about 20 weight percent to about 70 weight percent, and more specifically, from about 25 weight percent to about 50 weight percent of a phenolic resin, from about 2 weight percent to about 20 weight percent and, more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (OxyChem Company) and DURITE™ 97 (Borden Chemical), formaldehyde polymers with ammonia, cresol and phenol, such as VARCUM™ 29112 (OxyChem Company), formaldehyde polymers with 4,4'-(1-methylethylidene) bisphenol, such as VARCUM™ 29108 and 29116 (OxyChem Company), formaldehyde polymers with cresol and phenol, such as VARCUM™ 29457 (OxyChem Company), DURITE™ SD-423A, SD-422A (Borden Chemical), or formaldehyde polymers with phenol and p-tert-butylphenol, such as DURITE™ ESD 556C (Border Chemical).

Also included within the scope of the present disclosure are methods of imaging and printing with the photoresponsive devices illustrated herein. These methods generally involve the formation of an electrostatic latent image on the imaging member, followed by developing the image with a toner composition comprised, for example, of thermoplastic resin, colorant, such as pigment, charge additives, and surface additives, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same aforementioned sequence with the exception that the exposure step can be accomplished with a laser device or image bar.

The polyol esters can be obtained from a number of sources. Also, these esters can be prepared by esterifying a polyol and an aliphatic acid in the presence or absence of an acidic catalyst and using dehydrating condensation; preparing the aliphatic acid chloride which is then reacted with a polyol; or by an ester exchange reaction between an ester of a lower aliphatic alcohol and an aliphatic acid with a polyol. The mole ratio of hydroxyl to carboxylic acid or its equivalents, such as an acid chloride and acid ester, is, for example, about 1/1.

The following Examples are being submitted to illustrate embodiments of the present disclosure. These Examples are intended to be illustrative only and are not intended to limit the scope of the present disclosure. Also, parts and percentages are by weight unless otherwise indicated. Comparative Examples and data are also provided.

EXAMPLE I

Four multilayered photoreceptors of the rigid drum design were fabricated by conventional coating technology with an aluminum drum of 34 millimeters in diameter as the substrate. These four drum photoreceptors contained the same undercoat layer (UCL) and charge generating layer (CGL). The only difference was that one photoreceptor, Device I, contained a charge transport layer (CTL) comprising a film forming polymer binder, a charge transport compound, and the second device (Device II) contained the same layers as Device I except that the polyol ester ZELEC™ 887 (trimethylpropane tricaprylate, available from STEPAN Company, Northfield, Ill., USA) was incorporated into the charge transport layer. The third device (Device III) contained the same layers as Device I except that the polyol ester ZELEC™ 874 (pentaerythrityl tetracaprylate, available from STEPAN Company, Northfield, Ill., USA) was incorporated into the charge transport layer. The fourth device (Device IV) contained the same layers as Device I except that the polyol ester STEPAN BES (butoxy ethyl stearate, available from STEPAN Company, Northfield, Ill., USA) was incorporated into the charge transport layer.

More specifically, a titanium oxide/phenolic resin dispersion was prepared by ball milling 15 grams of titanium dioxide (STR60N™, Sakai Company), 20 grams of the phenolic resin (VARCUM™ 29159, OxyChem Company, $M_w$ of about 3,600, viscosity of about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin were prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometers pore size nylon cloth, and then the filtrate was measured with Horiba Capa 700 Particle Size Analyzer, and there was obtained a median $TiO_2$ particle size of 50 nanometers in diameter and a $TiO_2$ particle surface area of 30 $m^2$/gram with reference to the above $TiO_2$/VARCUM™ dispersion. Additional solvents of 5 grams of 1-butanol, and 5 grams of xylene; 5.4 grams of the above prepared SiO2/VARCUM™ slurry were added to 50 grams of the above resulting titanium dioxide/VARCUM™ dispersion, referred to as the coating dispersion. Then an aluminum drum, cleaned with detergent and rinsed with deionized water, was dip coated with the above generated coating dispersion at a pull rate of 160 millimeters/minute, and subsequently, dried at 145° C. for 45 minutes, which resulted in an undercoat layer (UCL) deposited on the aluminum and comprised of TiO2/SiO2/VARCUM™ with a weight ratio of about 60/10/40 and a thickness of 4 microns.

A 0.5 micron thick photogenerating layer was subsequently coated on top of the above generated undercoat layer from a dispersion of Type V hydroxygallium phthalocyanine (3.0 grams) and a vinyl chloride/vinyl acetate copolymer, VMCH ($M_n$=27,000, about 86 weight percent of vinyl chloride, about 13 weight percent of vinyl acetate and about 1 weight percent of maleic acid available from Dow Chemical (2 grams), in 95 grams of n-butylacetate. Subsequently, a 24 μm thick charge transport layer (CTL) was coated on top of the photogenerating layer from a solution prepared from N,N'-diphenyl-N,N-bis(3-methylphenyl)-1,1'-biphenyl-4,4'-diamine (5 grams) and a film forming polymer binder PCZ-400 [poly(4,4'-dihydroxy-diphenyl-1-1-cyclohexane, $M_w$=40,000)] available from Mitsubishi Gas Chemical Company, Ltd. (7.5 grams) dissolved in a solvent mixture of 20 grams of tetrahydrofuran (THF) and 6.7 grams of toluene. The CTL was dried at 120° C. for 40 minutes to provide the photoreceptor Device I.

Device II was prepared by repeating the above process except that ZELEC 887 (trimethylpropane tricaprylate, 0.625 gram) was added into the charge transport layer.

Device III was prepared by repeating the above process except that ZELEC™ 874 (pentaerythrityl tetracaprylate, 0.625 gram) was added into the charge transport layer.

Device IV was prepared by repeating the above process except that STEPAN BES™ (butoxy ethyl stearate, 0.625 gram) was added into the charge transport layer.

The above prepared four photoreceptor devices were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 and 700 volts with the exposure light intensity incrementally increased by means of regulating a series of neutral density filters; the exposure light source was a 780 nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Four photoinduced discharge characteristic (PIDC) curves were obtained from the two different pre-exposed surface potentials, and the data was interpolated into PIDC curves at an initial surface potential of 700 volts. These four devices possessed similar electrical performance characteristics. Incorporation of polyol ester in charge transport layer did not appear to adversely affect the electrical properties of the imaging members.

EXAMPLE II

Wear resistance tests of the above four devices were performed using a FX469 (Fuji Xerox) wear fixture. The total thickness of each device was measured via Permascope before each wear test was initiated. Then the devices were separately placed into the wear fixture for 50 kcycles. The total thickness was measured again, and the difference in thickness was used to calculate wear rate (nm/kcycle) of the device. The smaller the wear rate the more wear resistant is the imaging member. The wear rate data were summarized as:

| Device | Wear Rate (nm/kcylce) |
|---|---|
| I | 80 ± 2 |
| II | 56 ± 1 |
| III | 60 ± 2 |
| IV | 55 ± 1 |

Incorporation of polyol ester improves wear resistance of the imaging member by about 30 percent.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A photoconductive imaging member comprised of a photogenerating layer, and a charge transport layer containing a binder and a polyol ester.

2. An imaging member in accordance with claim 1 comprised of a substrate, a photogenerating layer, and a charge transport layer comprised of a charge transport component, said binder and said ester.

3. An imaging member in accordance with claim 2 wherein said ester is generated from the reaction of a polyol containing at least one hydroxyl group and a monobasic acid or an acid halide.

4. An imaging member comprised of a substrate, a photogenerating layer, and a charge transport layer comprised of a charge transport component, a binder resin, and a polyol ester, and wherein said ester is selected from the group comprised of trimethylpropane tricaprylate, pentaerythrityl tetracaprylate, neopentyl glycol caprylate caprate mixed ester, trimethylolpropane valerate heptanoate mixed ester, trimethylolpropane decanoate octanoate mixed ester, trimethylolpropane nananoate, pentaerythritol heptanoate caprate mixed ester, and butoxy ethyl stearate, and optionally mixtures thereof.

5. An imaging member in accordance with claim 3 wherein said ester contains from 1 to about 4 hydroxyl groups.

6. An imaging member in accordance with claim 3 wherein said polyol is a saturated or unsaturated straight or branched chain linear aliphatic; saturated or unsaturated cyclic aliphatic, including heterocyclic aliphatic; or a mononuclear or a polynuclear aromatic alcohol.

7. An imaging member in accordance with claim 1 wherein said polyol is trimethylol propane, ditrimethylol propane, pentaerythritol, dipentaerythritol, and tripentaerythritol.

8. An imaging member in accordance with claim 3 wherein said polyol contains from 1 to about 3 hydroxyl groups.

9. An imaging member in accordance with claim 3 wherein said monobasic acid is valeric acid, pivalic acid, heptanoic acid, octanoic acid, nonanoic acid, decanoic acid, lauric acid, myristic acid, palmitic acid or stearic acid.

10. An imaging member in accordance with claim 2 wherein said ester is generated from the reaction of a polyol having one or more hydroxyl groups in one molecule with a dibasic acid or a dibasic acid chloride.

11. An imaging member in accordance with claim 2 wherein said ester is dioctyl adipate, dioctyl sebacate, diisodecyl adipate, or didecyl adipate.

12. An imaging member in accordance with claim 1 wherein said ester is dispersed or dissolved in said binder and in said charge transport layer.

13. An imaging member in accordance with claim 1 wherein said ester is present in an amount of from about 0.1 to about 20 percent by weight.

14. An imaging member in accordance with claim 1 wherein said ester is present in an amount of from about 2 to about 10 percent by weight.

15. An imaging member in accordance with claim 1 wherein said ester is dispersed or dissolved in said resin binder, and wherein said binder is a polycarbonate.

16. An imaging member in accordance with claim 1 wherein said binder is a polycarbonate, a polyarylate, an acrylate polymer, a vinyl polymer, a cellulose polymer, a polyester, a polysiloxane, a polyamide, a polyurethane, a poly(cyclo olefin), or optionally an epoxy polymer.

17. An imaging member in accordance with claim 1 wherein said ester is dispersed in said binder, and which binder comprises polycarbonates, polyarylates, acrylate polymers, vinyl polymers, cellulose polymers, polyesters, polysiloxanes, polyamides, polyurethanes, poly(cyclo olefins), and epoxies, and wherein the amount of said ester is from about 3 to about 7 percent by weight; the amount of said binder is from about 50 to about 5 percent by weight; and the amount of a charge transport component present in said charge transport layer is from about 1 to about 50 percent by weight, and wherein the total of said components is about 100 percent.

18. An imaging member in accordance with claim 2 further including a hole blocking layer, and an adhesive layer situated, respectively, between said substrate and said photogenerating layer.

19. An imaging member in accordance with claim 18 wherein said hole blocking layer is comprised of an amino silane, or wherein said hole blocking layer is comprised of a metal oxide.

20. An imaging member in accordance with claim 2 wherein said substrate is a rigid drum, or wherein said substrate is a flexible belt.

21. An imaging member in accordance with claim 2 wherein said substrate is comprised of a conductive metal of aluminum, aluminized polyethylene terephthalate, titanized polyethylene terephthalate, or titanized polyethylene naphthalate; said photogenerator layer is of a thickness of from about 0.05 to about 10 microns, and wherein said transport layer is of a thickness of from about 20 to about 70 microns, and wherein said photogenerating layer is comprised of a photogenerating pigment or photogenerating pigments dispersed in a resinous binder, and wherein said pigment or pigments are present in an amount of from about 5 percent by weight to about 95 percent by weight, and wherein the resinous binder is optionally selected from the group comprised of vinyl chloride/vinyl acetate copolymers, polyesters, polyvinyl butyrals, polycarbonates, polystyrene-b-polyvinyl pyridine, and polyvinyl formals.

22. An imaging member in accordance with claim 2 wherein the charge transport layer comprises aryl amines, and which aryl amines are of the formula

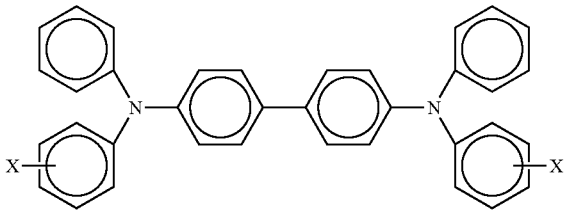

wherein X is selected from the group consisting of alkyl and halogen.

23. An imaging member in accordance with claim 22 wherein said aryl amine is N,N'-diphenyl-N,N-bis(3-methyl phenyl)-1,1'-biphenyl-4,4'-diamine.

24. An imaging member in accordance with claim 2 wherein said photogenerating layer is comprised of metal phthalocyanines, or metal free phthalocyanines.

25. A method of imaging which comprises generating an electrostatic latent image on the imaging member of claim 1, developing the latent image, and transferring the developed electrostatic image to a suitable substrate.

26. A photoconductive imaging member comprised in sequence of a substrate, a photogenerating layer, and a charge transport layer comprised of charge transport molecules, a binder and a polyol ester of the alternative formulas

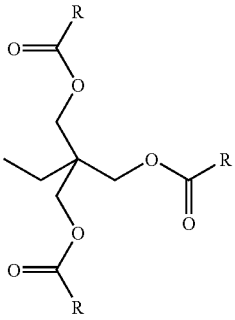

R = C7-C9 trimethylpropane tricaprylate

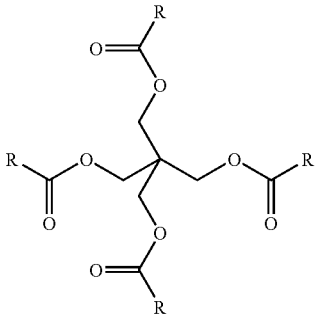

R = C7-C9 pentaerythrityl tetracaprylate

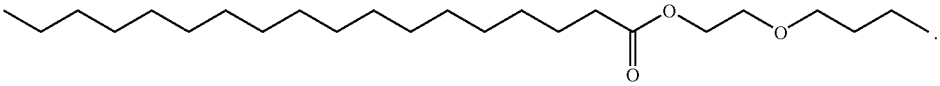

butoxyl ethyl stearate

27. A photoconductor comprised of a substrate, a photogenerating layer, and a charge transport layer comprised of a hole transport component, a polymer binder, and the polyol ester trimethylpropane tricaprylate, pentaerythrityl tetracaprylate, or butoxy ethyl stearate.

28. A photoconductor in accordance with claim 27 wherein said photogenerating layer is comprised of hydroxygallium phthalocyanine.

29. A photoconductive imaging member comprised of a photogenerating layer, and a charge transport layer containing a binder and a polyol ester, and wherein said polyol ester is trimethyl propane tricaprylate.

30. An imaging member in accordance with claim 4 wherein said photogenerating layer is comprised of hydroxygallium phthalocyanine.

31. A photoconductive imaging member consisting essentially of a photogenerating layer, and a charge transport layer containing a binder and a polyol ester.

* * * * *